US005779044A

United States Patent [19]

Myers, Jr.

[11] Patent Number: 5,779,044

[45] Date of Patent: Jul. 14, 1998

[54] GYM BAG FOR HOLDING A BASKETBALL

[76] Inventor: James D. Myers, Jr., 94 Cherry St., Malden, Mass. 02148

[21] Appl. No.: 585,907

[22] Filed: Jan. 16, 1996

[51] Int. Cl.[6] ..... B65D 85/00; B65D 85/30

[52] U.S. Cl. ..... 206/315.9; 206/573; 206/588

[58] Field of Search ..... 206/315.9, 315.1, 206/523, 521, 588, 590; 190/115, 127

[56] References Cited

U.S. PATENT DOCUMENTS

| | | | |
|---|---|---|---|
| 1,717,587 | 6/1929 | Shipley | 206/315.9 X |
| 3,158,238 | 11/1964 | Kish, Jr. | 206/315.9 |
| 3,181,693 | 5/1965 | Freistat | 206/523 |
| 3,266,605 | 8/1966 | Anderson et al. | 206/315.9 |
| 3,292,747 | 12/1966 | Dawson | 190/115 X |
| 3,308,911 | 3/1967 | Stevens et al. | 206/315.9 |
| 3,958,676 | 5/1976 | March | 190/127 X |
| 4,703,519 | 10/1987 | Krenzel | 190/115 X |
| 4,966,259 | 10/1990 | Bergman | 190/115 X |
| 5,085,320 | 2/1992 | Scott | 206/315.9 |

*Primary Examiner*—Bryon P. Gehman
*Attorney, Agent, or Firm*—John P. McGonagle

[57] ABSTRACT

A carrier for a basketball including a cover defining a cavity and an inner core element positioned within the cavity. The inner core element includes a first half and a second half. Each half has a first side and a second side which are hingedly connected together, and each has a semispherical cavity formed therein and both semispherical cavities together forming a ball cavity adapted to hold a basketball. The inner core element is formed of a strong material capable of supporting a seated man and positioned in the cavity of the cover.

18 Claims, 4 Drawing Sheets

GYM BAG FOR HOLDING A BASKETBALL

BACKGROUND OF THE INVENTION

This invention relates to gym bags, and in particular to a gym bag for holding a basketball and related items, such as a uniform, athletic shoes and the like.

Basketballs are spherical, precise, but bulky athletic items. Basketballs are made from materials making a basketball best suited for indoor, i.e., gym, use. Basketballs are not only played with, but are sat on, exposed to adverse weather conditions, and generally subject to a level of abuse which not only reduces the precision handling characteristics of the basketball but structurally weakens and eventually destroys the basketball. There is, therefore, a need for a gym bag which will allow easy and convenient transport of a player's basketball, as well as a gym bag which will protect the basketball from rough and ill-suit ed handling and weather conditions.

SUMMARY OF THE INVENTION

In view of the foregoing, the present invention provides a special carrying bag for a basketball. As such, the general purpose of the present invention, which will be described subsequently in greater detail, is to provide a gym bag which makes the transport of a basketball convenient while also providing protection from rough handling and adverse weather elements.

To attain this, the present invention provides a gym bag carrier for a basket ball comprising a cover, which defines a cavity and an inner core element. The inner core element is formed of a strong material and positioned in the cavity of the cover. The inner core element includes a first half and a second half. Each half has a first side and a second side which are hingedly connected together, and each has a semispherical cavity formed therein and both semispherical cavities together form a ball cavity adapted to hold a basket ball. Various embodiments of the invention have various sized cavities thereby providing more or less space for also carrying ancillary athletic items such as uniforms, shoes, and the like.

This together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
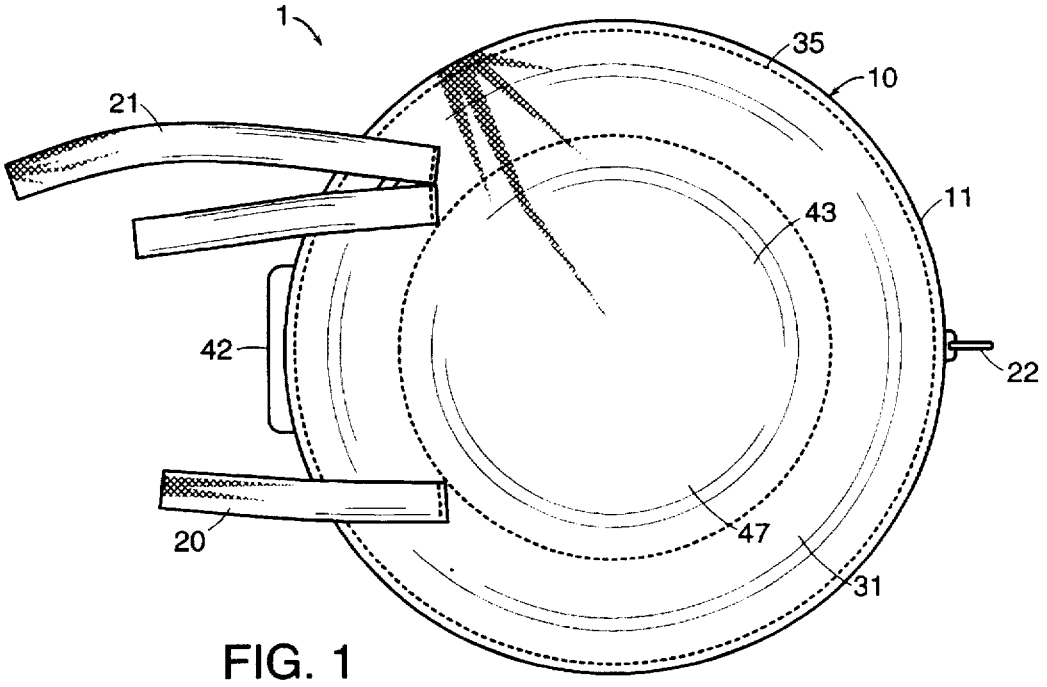
FIG. 1. is a top plan view of the carrier according to the present invention.

Referring to the drawings in detail wherein like elements are indicated by like numerals, there is shown an embodiment of the invention 1 incorporating gym bag constructed according to the principles of the invention. There is shown in the drawings at FIGS. 1–4 a gym bag carrier 10 which includes a canvas cover 11, and an inner core element 30. The cover 11 has an exterior surface 13 and defines an interior 12 forming a cavity or compartment. The cover 11 has a front 14, rear 15, two sides 16, a top 17 and a bottom 18. As may be most clearly seen in FIGS. 1–3, a short pair of hand straps 20 is attached to cover bottom 18 and extending to the cover top 17. A shoulder strap 21 is also attached to the cover bottom 18 and extending to the cover top 17. The canvas cover 11 is bag-like and has a horizontal zipper arrangement 22 formed centrally across the cover front 14. The zipper 22 is positioned so as to provide two halves to the cover 11. See FIGS. 3 and 4.

The inner core element 30 has a generally spherical shape and is formed from two halves, a first half 31 and a second half 32. Each half 31, 32 has an exterior 40, 41 and an interior 37, 38 with a semispherical cavity 33, 34 formed therein and both semispherical cavities 33, 34 together forming a ball cavity 41 adapted to hold a basketball (not shown). Each half 31, 32 has a rim 35, 36 separating the interior 37, 38 from the exterior 39, 40. The first half rim 35 is connected to the second half rim 36 by means of a hinge 42. The inner core element 30 is formed of a strong material, a plastic for example, capable of holding a seated man without crushing the inner core element 30 or the ball cavity 41. The inner core element first half exterior 39 has an apex area 43 formed as an inner core element first flat area 45. The inner core element second half exterior 40 has an apex area 44 formed as an inner core element second flat area 46.

With the basketball positioned in the ball cavity 41. The canvas cover 11 fits tightly about the inner core element 30 providing a seat 47 where it passes over the first flat area 45 and providing a support area 48 where it passes over the second flat area 46. The exterior 50 of the support area 48 may be provided with rubber or plastic feet 49 which are attached to the support area 48 by sewing or adhesion, for example, as indicated in FIGS. 1–4.

Figure 2:
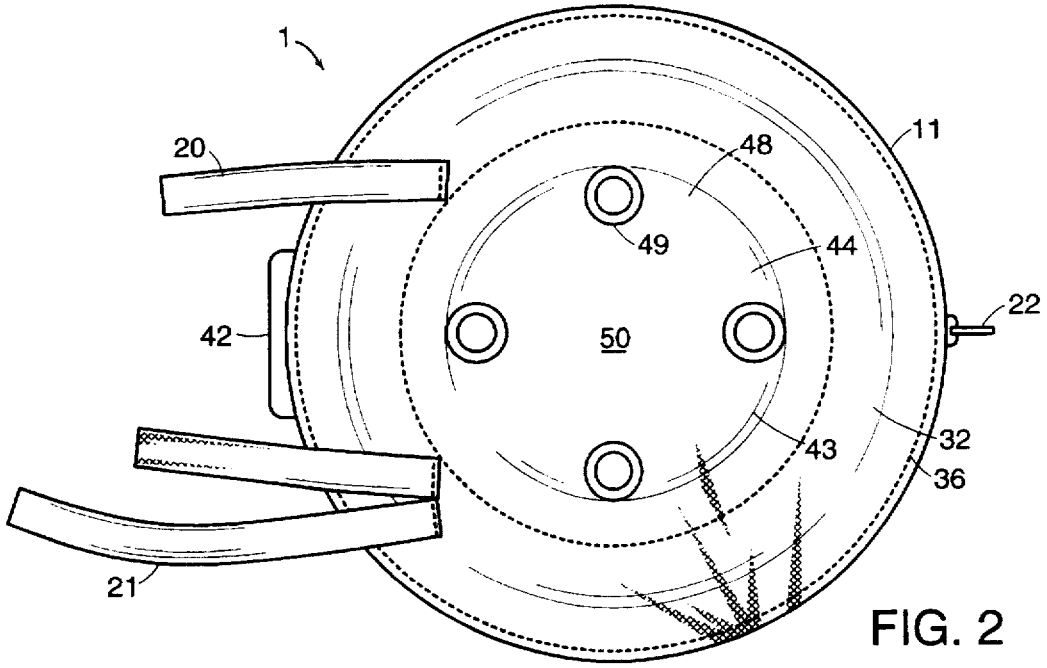
FIG. 2. is a bottom plan view of the carrier shown in FIG. 1.
Figure 3:
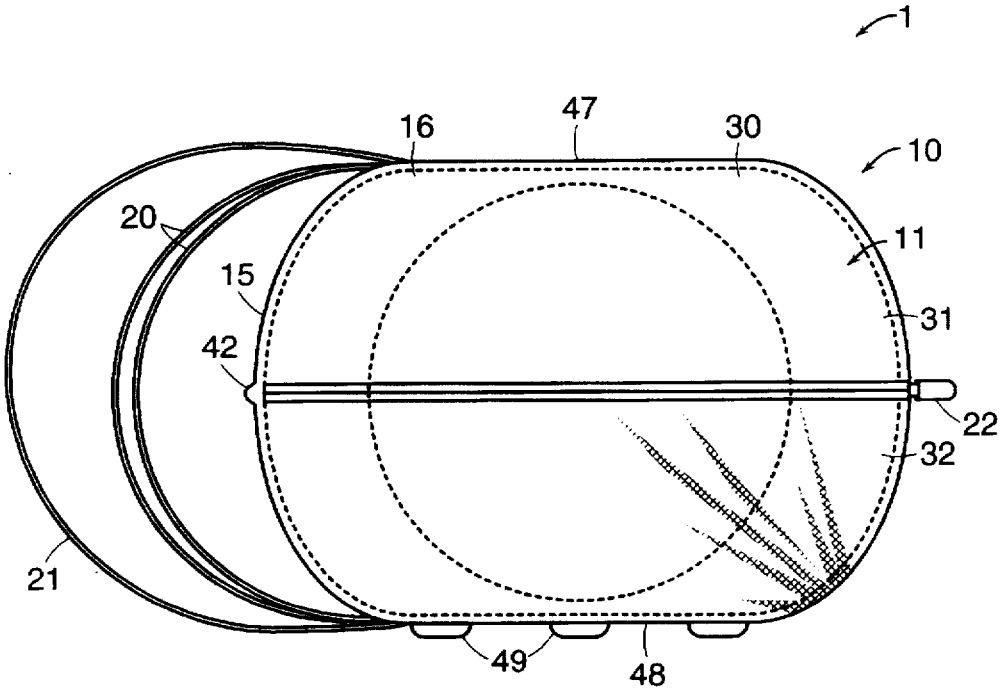
FIG. 3. is a side elevational view of the carrier shown in FIG. 1.
Figure 4:
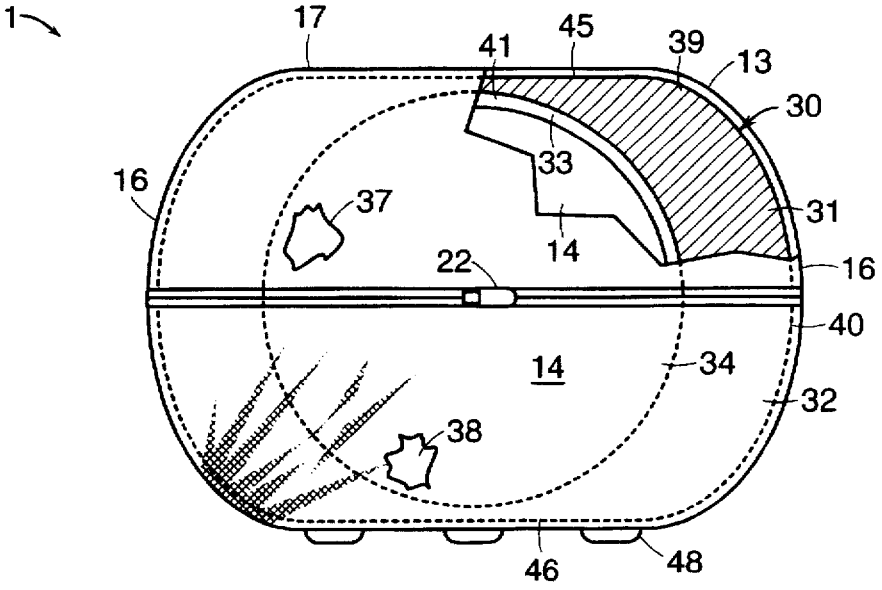
FIG. 4. is a front elevational of the carrier shown in FIG. 1.
Figure 6:
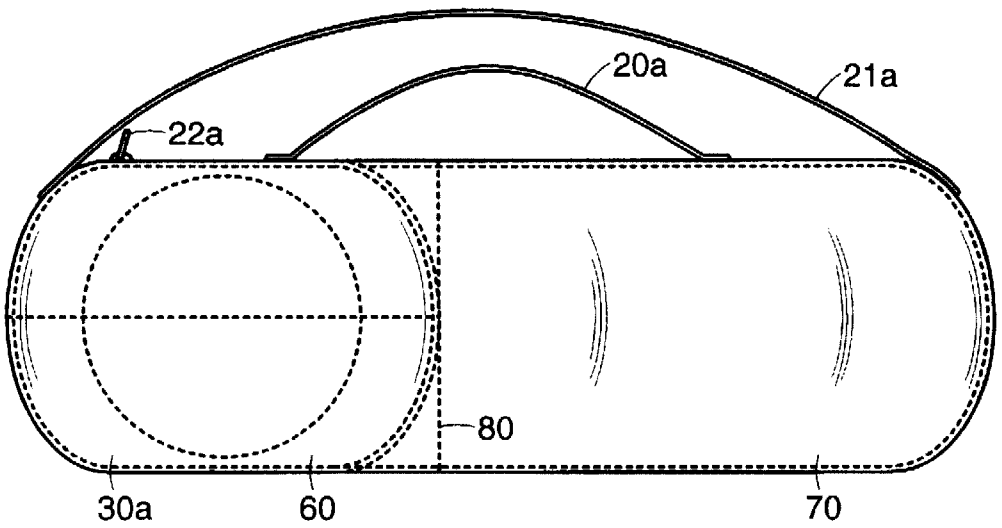
FIG. 6. is a front elevational view of a first variation of the carrier of shown in FIG. 5.
Figure 5:
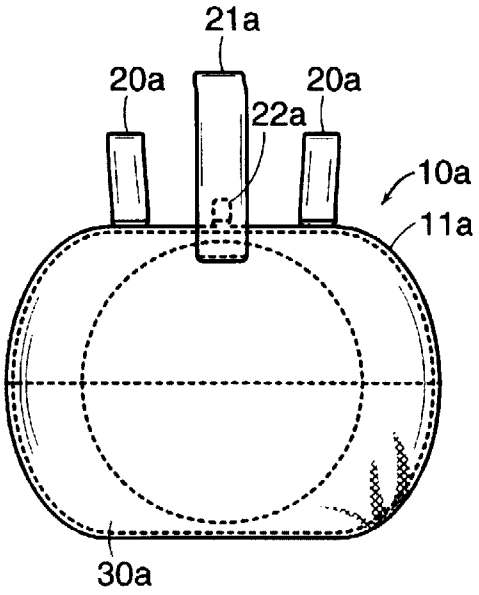
FIG. 5 is a side elevational view of a first variation of the carrier of shown in FIG. 1.

A first variation 10*a* of the carrier 10 is shown in FIGS. 5 & 6. The first variation 10*a* includes a canvas cover 11*a*, and an inner core element 30*a*. The inner core element 30*a* is identical to the inner core element 30. The cover 11*a* defines a first cavity or compartment 60 and a second cavity or compartment 70. The first cavity or compartment 60 is similar to the interior cavity or compartment 12 having an inner core element 30 except that a wall 80 divides the first cavity or compartment 60 from the second cavity or compartment 70 as shown FIG. 6. The carrier 10*a* is larger (that is longer) than the carrier 10. A short pair of hand straps 20*a* is attached to the cover 11*a* as shown in FIGS. 5 & 6 and a shoulder strap 21*a* is attached to the cover 11*a* as shown in FIGS. 1, 2, 3.

The canvas cover 11*a* is bag like and can be closed by a zipper arrangement 22*a*. The zipper 22*a* may be located so as to provide two halves to the cover 11*a* similar to the cover 11. A single hand strap 32*a* is positioned on each side of the zipper 22*a* and the shoulder strap 21*a* extends longitudinally along the length of the zipper 22*a*. The second compartment 46 is used for carrying clothes, etc.

Figure 8:
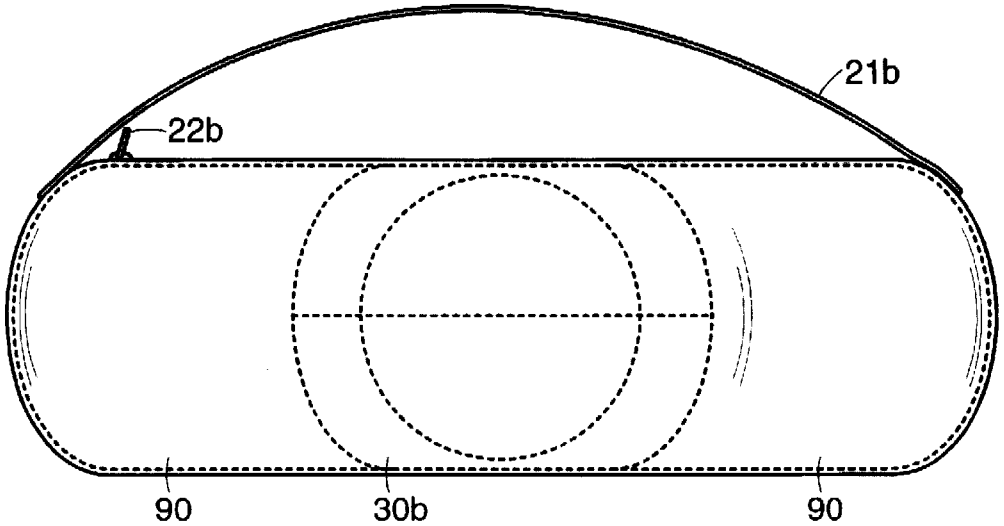
FIG. 8. is a front elevational view of the second variation of the carrier shown in FIG. 7.
Figure 7:
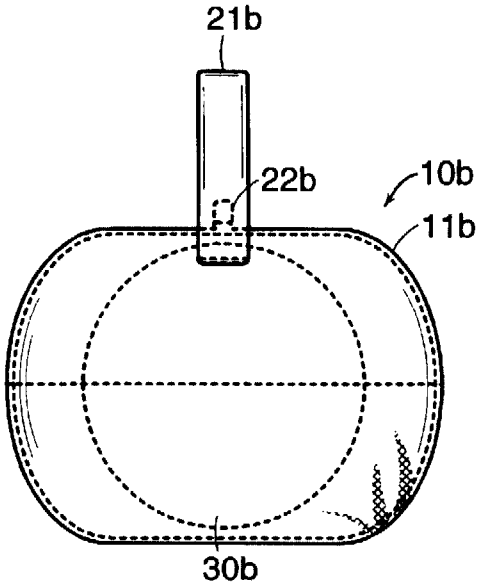
FIG. 7 is an end elevational view of a second variation of the carrier of shown in FIG. 1.

Another variation 10b of the carrier 10 is shown in FIGS. 7 & 8. This carrier variation 10b includes a canvas cover 11b, and an inner core element 30b. The inner core element 30b is identical to the inner core element 30. The cover 11b defines an enlarged compartment section 12b. The carrier 10b is larger (that is longer) then the carrier 10. An inner core element 30b, identical to the inner core element 30, is positioned centrally in the compartment section 12b leaving spaces 90 on both sides of the inner core element 30b as shown in FIG. 8. A shoulder strap 21b is attached to the cover 11b as shown in FIGS. 7 & 8.

The canvas cover 11b is bag like and can be closed by a horizontal, longitudinal zipper arrangement 22b. The zipper 22b may be located so as to provide two halves to the cover 11b similar to the cover 11. The shoulder strap 21b extends longitudinally along the length of the zipper 22b. The spaces 90 on each side of the inner core 30b may be used for carrying clothes, etc.

It is understood that the above-described embodiment is merely illustrative of the application. Other embodiments may be readily devised by those skilled in the art which will embody the principles of the invention and fall within the spirit and scope thereof.

I claim:

1. A gym bag carrier for holding a basketball, a uniform, athletic shoes and accessories, comprising:

a flexible cover having an exterior surface and defining an interior forming a compartment, said cover having a front, rear, two sides, a top and a bottom;

a rigid inner core element contained within said cover compartment, said inner core element having a generally spherical shape formed with two halves, a first half and a second half, each half having an exterior and an interior with a semispherical cavity formed therein and both said semispherical cavities together forming a ball cavity adapted to hold a basketball; and a horizontal zipper arrangement formed centrally across said cover, said zipper being arranged as part of the cover to provide two halves.

2. A gym bag carrier as recited in claim 1, further comprising:

a pair of hand straps attached to said cover bottom and extending to and attached to said cover top.

3. A gym bag carrier as recited in claim 2, further comprising:

a shoulder strap attached to said cover bottom and extending to and attached to said cover top.

4. A gym bag carrier as recited in claim 3, wherein:

each said inner core element half has a rim separating said inner core element half interior from said inner core element half exterior, said first half rim being connected to said second half rim by means of a hinge.

5. A gym bag carrier as recited in claim 4, wherein:

said inner core element first half exterior has an apex area formed as an inner core element first flat area; and said inner core element second half exterior has an apex area formed as an inner core element second flat area.

6. A gym bag carrier as recited in claim 5, wherein:

said cover is adapted to fit tightly about said inner core element providing a seat where it passes over said first flat area and providing a support area where it passes over said second flat area.

7. A gym bag carrier as recited in claim 6, further comprising:

a plurality of feet attached to the exterior of said support area.

8. A gym bag carrier as recited in claim 7, wherein:

said inner core element is formed of a plastic, capable of holding a seated man without crushing said inner core element.

9. A gym bag carrier as recited in claim 1, wherein:

said compartmentcis large and said inner core element is positioned centrally in said compartment leaving interior spaces on both sides of said inner core element.

10. A gym bag carrier as recited in claim 9, further comprising:

a shoulder strap attached to said c over top and extending fro m one side to the other side.

11. A gym bag carrier for holding a basketball, a uniform, athletic shoes and accessories, comprising:

a flexible cover having an exterior surface and defining an interior forming a first compartment and a second compartment separated by a wall, said cover having a front, rear, two sides, a top and a bottom;

a rigid inner core element contained within said cover first compartment, said inner core element having a generally spherical shape formed with two halves, a first half and a second half, each half having an exterior and an interior with a semispherical cavity formed therein and both said semispherical cavities together forming a ball cavity adapted to hold a basketball; and a horizontal zipper arrangement formed centrally across said cover, said zipper being arranged as part of the cover to provide two halves.

12. A gym bag carrier as recited in claim 11, further comprising:

a pair of hand straps attached to said cover top.

13. A gym bag carrier as recited in claim 12, further comprising:

a shoulder strap attached to said cover top.

14. A gym bag carrier as recited in claim 13, wherein:

each said inner core element half has a rim separating said inner core element half interior from said inner core element half exterior, said first half rim being connected to said second half rim by means of a hinge.

15. A gym bag carrier as recited in claim 14, wherein:

said inner core element first half exterior has an apex area formed as an inner core element first flat area; and said inner core element second half exterior has an apex area formed as an inner core element second flat area.

16. A gym bag carrier as recited in claim 15, wherein:

said cover is adapted to fit tightly about said inner core element providing a seat where it passes over said first flat area and providing a support area where it passes over said second flat area.

17. A gym bag carrier as recited in claim 16, further comprising:

a plurality of feet attached to the exterior of said support area.

18. A gym bag carrier as recited in claim 17, wherein:

said inner core element is formed of a plastic, capable of holding a seated man without crushing said inner core element.

* * * * *